US007346304B2

(12) United States Patent
Takagi

(10) Patent No.: US 7,346,304 B2
(45) Date of Patent: Mar. 18, 2008

(54) TRANSFER DEVICE HAVING GUIDING MEMBER THAT GUIDES RECORDING MEDIUM TO TRANSFER POSITION

(75) Inventor: Takeyuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 128 days.

(21) Appl. No.: 11/410,220

(22) Filed: Apr. 25, 2006

(65) Prior Publication Data

US 2006/0238788 A1 Oct. 26, 2006

(30) Foreign Application Priority Data

Apr. 25, 2005 (JP) ..... 2005-126197

(51) Int. Cl.
*G03G 15/16* (2006.01)

(52) U.S. Cl. ..... 399/316; 399/121; 399/388

(58) Field of Classification Search ..... 399/316, 399/121, 388, 107, 111
See application file for complete search history.

(56) References Cited

U.S. PATENT DOCUMENTS 4,882,606 A * 11/1989 Deguchi ..... 399/316
5,689,794 A 11/1997 Kondo
7,113,734 B2 * 9/2006 Deguchi et al. ..... 399/316
2001/0010469 A1 * 8/2001 Ishii et al. ..... 399/388
2002/0025187 A1 * 2/2002 Sato et al. ..... 399/111
2005/0265757 A1 * 12/2005 Deguchi ..... 399/316

FOREIGN PATENT DOCUMENTS

JP 5046031 2/1993
JP 8036313 2/1996
JP 8239140 9/1996
JP 2000007178 1/2000
JP 2000-214695 A * 8/2000

* cited by examiner

*Primary Examiner*—Sophia S. Chen
(74) *Attorney, Agent, or Firm*—Banner & Witcoff, Ltd.

(57) ABSTRACT

A guiding member is disposed at a frame upstream of a transfer roller in a conveying direction, thereby guiding a recording medium to a transfer position. The guiding member has front and back surfaces. A guiding portion of the guiding member is configured to contact the recording medium for guiding the recording medium to the transfer position. The base portion is positioned upstream of the guiding portion in the conveying direction. The base portion is formed with at least one through-hole having an inner edge. The frame includes a supporting portion and a protruding portion. The supporting portion is configured to contact the back surface of the guiding member, thereby supporting the guiding member. The protruding portion protrudes through the at least one through-hole and engages with the inner edge, thereby fixing the base portion of the guiding member to the frame.

19 Claims, 4 Drawing Sheets

TRANSFER DEVICE HAVING GUIDING MEMBER THAT GUIDES RECORDING MEDIUM TO TRANSFER POSITION

CROSS REFERENCE TO RELATED APPLICATIONS

This application claims priority from Japanese Patent Application No. 2005-126197 filed Apr. 25, 2005. The entire content of the priority application is incorporated herein by reference.

TECHNICAL FIELD

The disclosure relates to a transfer device that transfers a developer borne on a circumferential surface of an image bearing member on a conveyed recording medium. The disclosure also relates to an image forming apparatus that forms an image on a recording medium by transferring developer borne on the circumferential surface of the image bearing member on a conveyed recording medium. The disclosure also relates to a process cartridge configured to be detachable from the image forming apparatus.

BACKGROUND

Japanese Patent Application Publication No. 8-36313 discloses an image forming apparatus that transfers developer to a recording medium. In the image forming apparatus, at the side upstream of a transfer position at which a toner image (image formed by the developer) formed on a photosensitive member (image bearing member) is transferred on a transfer paper (recording medium) in a paper conveying direction is provided a guide member for guiding the transfer paper to the transfer position. The guide member is made of a synthetic resin film capable of elastically bending and the film is supported by a synthetic resin plate. With such configuration, since the transfer paper can be stably guided to the transfer position in a good fashion, transfer failure (white spot) of the toner on the transfer paper can be prevented.

SUMMARY

However, in the above-described configuration, the film is fixed to the plate using a screw or an adhesive tape. Accordingly, the operation of fixing the film to the plate requires processes of cleaning the surface of the plate (for example, wiping by an organic solvent), removing a release paper of the adhesive tape and adhering the adhesive tape to the film or the plate. Therefore, the number of processes for fixing the film to the plate is increased.

Especially in recent compact and multi-functional image forming apparatuses for small offices and home offices (SOHO), internal structure of the apparatus itself and the process cartridge becomes minute and complicated. Consequently, the fixing operation of the film by the adhesive tape or the screw is very cumbersome.

In view of the foregoing, it is an object of the invention to provide a transfer device, a process cartridge and an image forming apparatus in which developer can be satisfactorily transferred onto a recording medium without any complicated operations.

In order to attain the above and other objects, the invention provides a transfer device. The transfer device includes a frame, a transfer roller, and a guiding member. The transfer roller is rotatably supported by the frame. The guiding member is disposed at the frame upstream of the transfer roller in a conveying direction of a recording medium, thereby guiding the recording medium to a transfer position. The guiding member has a front surface configured to confront the recording medium and a back surface opposite the front surface. The guiding member includes a guiding portion and a base portion. The guiding portion is configured to contact the recording medium for guiding the recording medium to the transfer position. The base portion is positioned upstream of the guiding portion in the conveying direction. The base portion is formed with at least one through-hole. Each through-hole has an inner edge. The frame includes a supporting portion and a protruding portion. The supporting portion is configured to contact the back surface of the guiding member, thereby supporting the guiding member. The protruding portion protrudes through the at least one through-hole and engages with the inner edge, thereby fixing the base portion of the guiding member to the frame.

According to another aspect, the invention provides an image forming apparatus. The image forming apparatus includes a frame, an image bearing member, a transfer roller, and a guiding member. The image bearing member has a peripheral surface and is configured to bear a developer image thereon. The transfer roller is rotatably supported by the frame and is disposed in confrontation with the image bearing member. The image bearing member and the transfer roller confront each other at a transfer position. The transfer roller transfers the developer image borne on the peripheral surface of the image bearing member to a recording medium. The guiding member is disposed at the frame upstream of the transfer roller in a conveying direction of the recording medium, thereby guiding the recording medium to the transfer position. The guiding member has a front surface configured to confront the recording medium and a back surface opposite the front surface. The guiding member includes a guiding portion and a base portion. The guiding portion is configured to contact the recording medium for guiding the recording medium to the transfer position. The base portion is positioned upstream of the guiding portion in the conveying direction. The base portion is formed with at least one through-hole. Each through-hole has an inner edge. The frame includes a supporting portion and a protruding portion. The supporting portion is configured to contact the back surface of the guiding member, thereby supporting the guiding member. The protruding portion protrudes through the at least one through-hole and engages with the inner edge, thereby fixing the base portion of the guiding member to the frame.

According to another aspect, the invention provides a process cartridge configured to be detachably mounted on an image forming apparatus. The process cartridge includes a cartridge frame, an image bearing member, a transfer roller, and a guiding member. The image bearing member has a peripheral surface and is configured to bear a developer image thereon. The transfer roller is rotatably supported by the cartridge frame and is disposed in confrontation with the image bearing member. The image bearing member and the transfer roller confront each other at a transfer position. The transfer roller transfers the developer image borne on the peripheral surface of the image bearing member to a recording medium. The guiding member is disposed at the cartridge frame upstream of the transfer roller in a conveying direction of the recording medium, thereby guiding the recording medium to the transfer position. The guiding member has a front surface configured to confront the recording medium and a back surface opposite the front surface. The guiding member includes a guiding portion and a base portion. The guiding portion is configured to contact the recording medium for guiding the recording medium to the transfer position. The base portion is positioned upstream of the guiding portion in the conveying direction. The base portion is formed with at least one through-hole. Each through-hole has an inner edge. The cartridge frame includes a supporting portion and a protruding portion. The supporting portion is configured to contact the back surface of the guiding member, thereby supporting the guiding member. The protruding portion protrudes through the at least one through-hole and engages with the inner edge, thereby fixing the base portion of the guiding member to the cartridge frame.

BRIEF DESCRIPTION OF THE DRAWINGS

Illustrative aspects in accordance with the invention will be described in detail with reference to the following figures wherein.

DETAILED DESCRIPTION

A transfer device, an image forming apparatus, and a process cartridge according to illustrative aspects of the invention will be described while referring to the accompanying drawings.

In the following description, the expressions "front", "rear", "upper", and "lower" are used to define the various parts when the image forming apparatus is disposed in an orientation in which it is intended to be used.

<Overall Configuration of Laser Printer>

Figure 1:
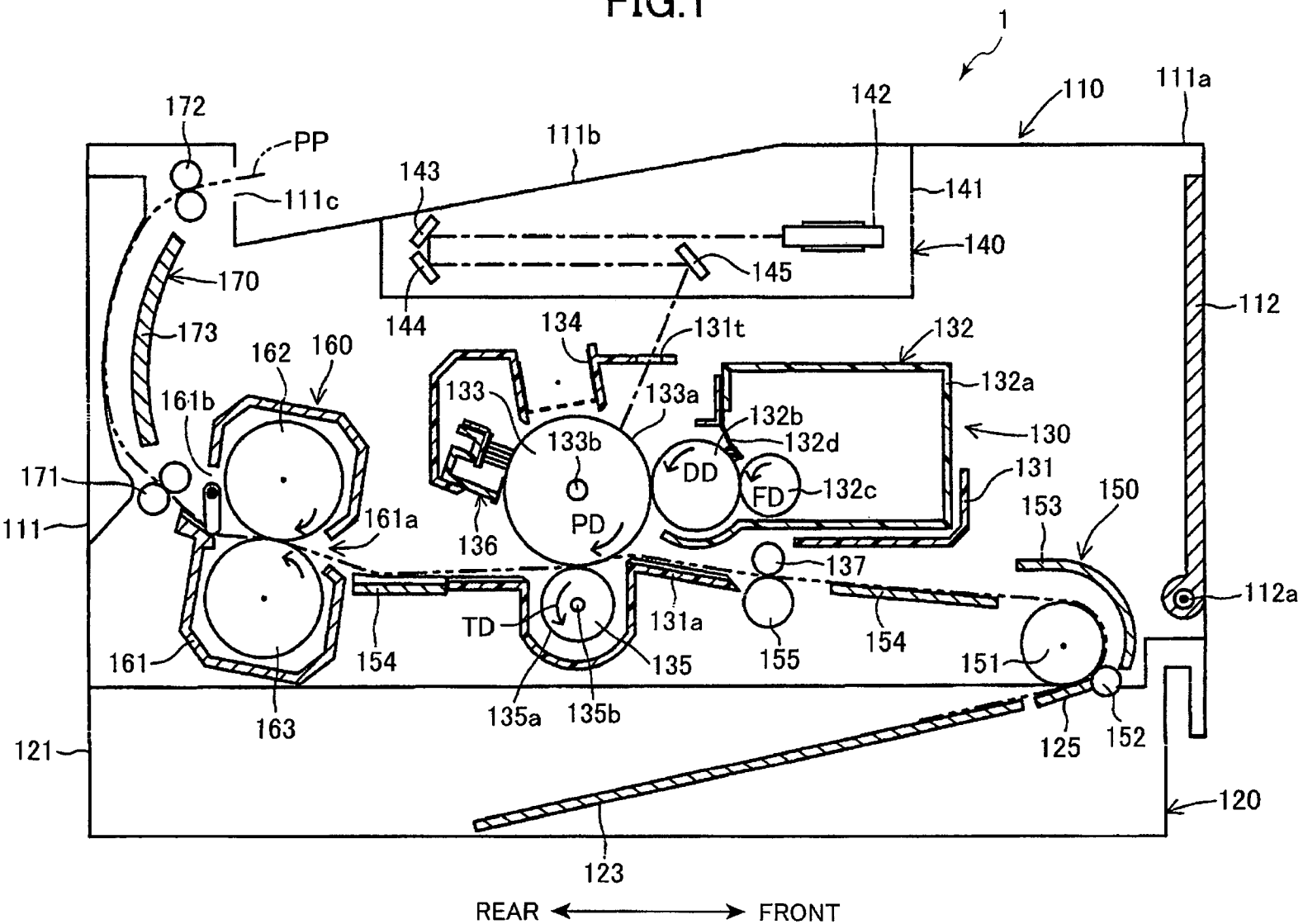
FIG. 1 is a cross-sectional view showing a schematic configuration of a laser printer according to illustrative aspects of the invention.

FIG. 1 is a vertical cross-sectional view of a laser printer 1 according to illustrative aspects.

The laser printer 1 has a main body 110 and a feeder unit 120 for feeding a recording medium (paper) to the main body 110. A process cartridge 130 for forming an image formed by a developer (toner) on the paper is detachably mounted on the main body 110. A scanner unit 140 for irradiating a photosensitive drum 133 in the process cartridge 130 with a laser beam is also disposed in the main body 110. Furthermore, in the main body 110 are disposed a paper feeding part 150 for feeding the paper toward the process cartridge 130, a fixing unit 160 for fixing the toner image formed on the paper by the process cartridge 130 on the paper and a paper discharge unit 170 for discharging the paper which has passed through the fixing unit 160 to the outside of the laser printer 1.

<Explanation of Terms "Paper Conveying Direction", "Paper Width Direction", "Front Side", and "Rear Side">

The laser printer 1 is configured so that the paper can be conveyed along a paper path PP (represented by a two-dot chain line in FIG. 1). Thus, in the following description, a direction in which the paper moves from the feeder unit 120 toward the paper discharge unit 170 along the paper path PP in FIG. 1 is referred to as a "paper conveying direction".

A right end of the laser printer 1 in FIG. 1 is referred to as "front side" of the laser printer 1, and a left end of the laser printer 1 is referred to as "rear side" of the laser printer 1.

A direction (that is, a direction perpendicular to a surface of drawing of FIG. 1: a width direction of the laser printer 1) perpendicular to the paper conveying direction and vertical direction (a height direction of the laser printer 1) in FIG. 1 is referred to as a "paper width direction".

<Configuration of Casing of Main Body>

An outer cover 111 is a member shaped like a substantially rectangular parallelepiped constituting a casing of the main body 110. The outer cover 111 is integrally formed of a synthetic resin plate. The outer cover 111 is provided so as to cover a main frame (not shown) for supporting various members accommodated in the main body 110. A paper discharge tray 111*b* is formed on a top surface 111*a* of the outer cover 111. The paper discharge tray 111*b* is formed of a slope obliquely extending downward from the front side toward the rear side. That is, the paper discharge tray 111*b* is formed of a recessed part formed on the top surface 111*a*. A paper discharge opening 111*c* is formed at an upper portion and above a bottom end of the paper discharge tray 111*b*. The paper discharge tray 111*b* is configured to receive the paper discharged from the paper discharge opening 111*c*.

An opening is formed on the front surface of the outer cover 111 and a plate-like front cover 112 is disposed so as to cover the opening. At a bottom end of the front cover 112 is formed a hole 112*a* as the center of pivotal movement of the front cover 112. A pair of pins (not shown) is disposed along the paper width direction on the opening of the outer cover 111. The pins are inserted into the hole 112*a* of the front cover 112 so that the front cover 112 can be supported so as to be pivotally movable about the pins.

The laser printer 1 in the illustrative aspects is configured so that the process cartridge 130 can be mounted or detached from the front side of the laser printer 1 by opening the front cover 112 to the front side (right side in FIG. 1).

<Configuration of Feeder Unit>

A feeder case 121 constituting a casing of the feeder unit 120 is configured to accommodate multiple sheets of paper in a stacked state therein. A paper pressing plate 123 and a separating pad 125 are arranged in the feeder case 121.

The paper pressing plate 123 is swingably supported about one end on the rear side (a side farther from the separating pad 125 in FIG. 1). The other end on the front side (a side closer from the separating pad 125 in FIG. 1) of the paper pressing plate 123 is urged to move upward by a spring (not shown). A top surface of the separating pad 125 is made of a material having a higher friction coefficient than paper, for example, a rubber.

<Configuration of Process Cartridge>

A developing cartridge 132 is detachably mounted on a process frame 131, constituting a casing and a frame of the process cartridge 130.

<Configuration of Developing Cartridge>

The developing cartridge 132 is disposed at a side of the photosensitive drum 133 accommodated in the process frame 131. The developing cartridge 132 is configured as follows so as to supply a toner (developer) to a circumferential surface (peripheral surface) 133*a* of the photosensitive drum 133 on which an electrostatic latent image is formed, thereby bearing toner in a form of an image on the circumferential surface 133*a* (developing the electrostatic latent image by the toner).

The toner as a developer for developing the electrostatic latent image is accommodated in a developing unit case 132*a* that constitutes a casing of the developing cartridge 132. A developing roller 132*b* is supported at an end of the developing unit case 132*a* so as to be rotatable in a direction shown by an arrow DD in FIG. 1. The developing roller 132*b* is in confrontation with the photosensitive drum 133. The developing roller 132*b* is configured by forming a semi-conductive rubber layer obtained by mixing a carbon black into a synthetic rubber around an outer circumference of a metallic rotational shaft.

A feeding roller 132*c* is rotatably supported at a position which is front of the developing roller 132*b* and on the inward side of the developing unit case 132*a*. The feeding roller 132*c* is configured by forming a sponge layer around an outer circumference of a metallic rotational shaft. The feeding roller 132*c* can bear the charged toner on the circumferential surface of the developing roller 132*b* by being rotationally driven in a direction shown by an arrow FD at the time of image formation. A blade 132*d* is fixed to the developing unit case 132*a* on the outer side than a contact part (nip part) of the developing roller 132*b* and the feeding roller 132*c*. The blade 132*d* is disposed so that its front end can contact the circumferential surface of the developing roller 132*b*, thereby adjusting density and charge amount of the toner on the circumferential surface of the developing roller 132*b*.

<Schematic Configuration of Process Frame>

The process frame 131 accommodates the photosensitive drum 133 therein. The photosensitive drum 133 is supported by the process frame 131 so as to be rotatable about a rotational shaft 133*b* in a direction shown by an arrow PD in synchronization with the conveyance of the paper at the time of image formation.

A charger 134 is disposed above the photosensitive drum 133 for uniformly charging the circumferential surface 133*a* of the photosensitive drum 133. The charger 134 is supported by the process frame 131. A slit 131*t* is formed at an upper portion of the process frame 131 as a passage of the laser beam for irradiating the circumferential surface 133*a* of the photosensitive drum 133 with the laser beam. That is, the slit 131*t* is configured so that the electrostatic latent image can be formed on the circumferential surface 133*a* of the photosensitive drum 133 by irradiating the uniformly charged circumferential surface 133*a* of the photosensitive drum 133 with the laser beam modulated in accordance with image information through the slit 131*t*.

The process frame 131 accommodates therein a transfer roller 135 for transferring the toner borne on the circumferential surface 133*a* of the photosensitive drum 133 on the paper. The transfer roller 135 is disposed below the photosensitive drum 133 and on the bottom of the process cartridge 130 so that an upper portion of a circumferential surface 135*a* confronts the photosensitive drum 133. The transfer roller 135 is supported by the process frame 131 so as to be rotatable about a rotational shaft 135*b* and rotates in a direction shown by an arrow TD in FIG. 1 in synchronization with the rotation of the photosensitive drum 133 in the direction of the arrow PD in the figure at the time of image formation.

A bottom of the transfer roller 135 is covered with a transfer roller cover 131*a* which constitutes a part of the process frame 131. A portion of the transfer roller cover 131*a* upstream of the transfer roller 135 in the paper conveying direction is in confrontation with a paper path PP, thereby guiding the paper to a transfer position at which the photosensitive drum 133 confronts the transfer roller 135 (both comes closest to each other).

A cleaning part 136 for cleaning the circumferential surface 133*a* of the photosensitive drum 133 is disposed in the process frame 131. The cleaning part 136 is disposed so as to contact the circumferential surface 133*a* of the photosensitive drum 133 with a predetermined pressure, downstream from a position at which the photosensitive drum 133 confronts the transfer roller 135 across the paper path PP in the rotating direction of the photosensitive drum 133.

An upper registration roller 137 is rotatably supported below the process frame 131 for adjusting orientation and conveying timing of the paper.

<Detailed Configuration in the Vicinity of Transfer Position>

Figure 2A:
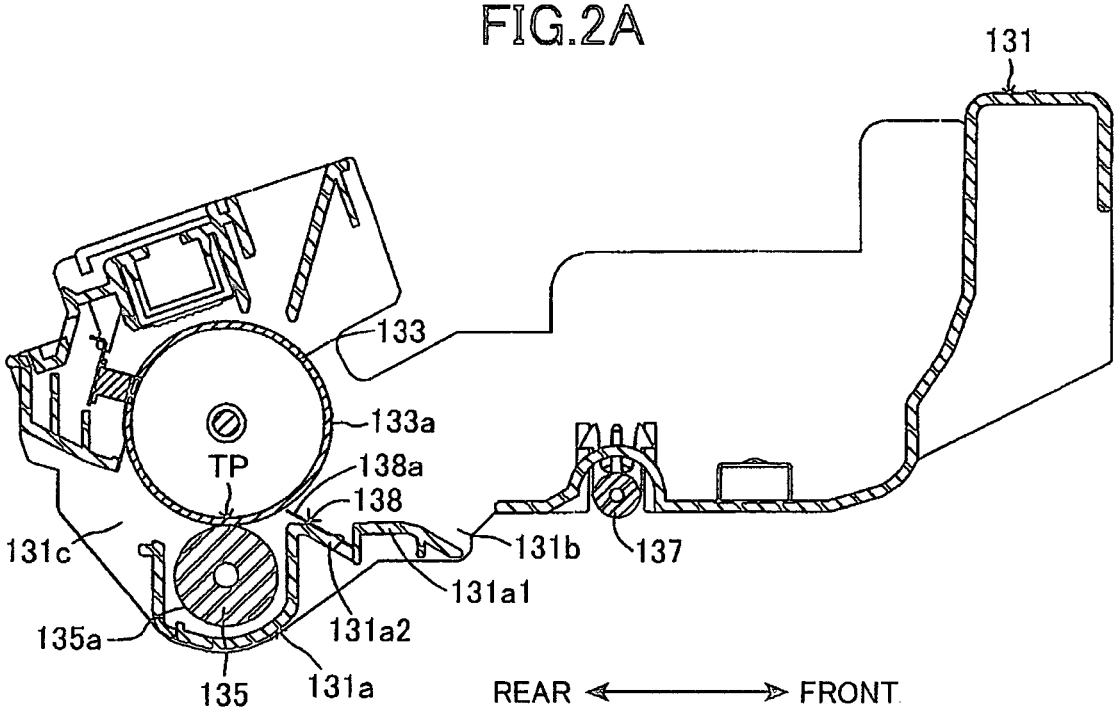
FIG. 2A is an enlarged cross-sectional view of a process frame in the laser printer shown in FIG. 1.
Figure 2B:
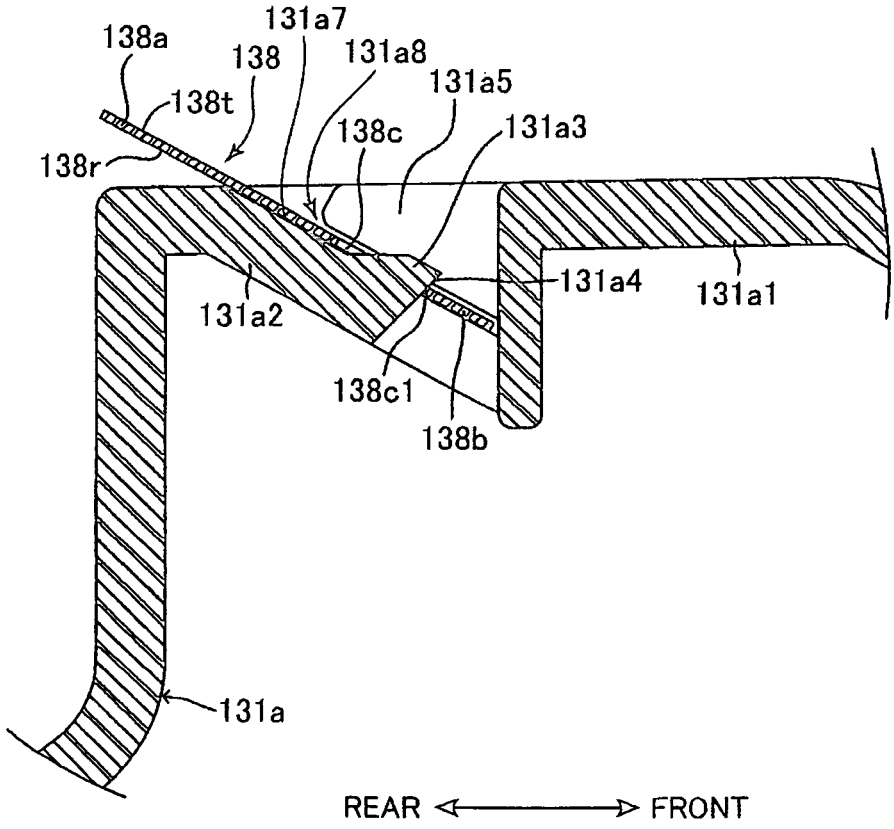
FIG. 2B is a further enlarged cross-sectional view of part of the process frame upstream of a transfer roller in a paper conveying direction.
Figure 3A:
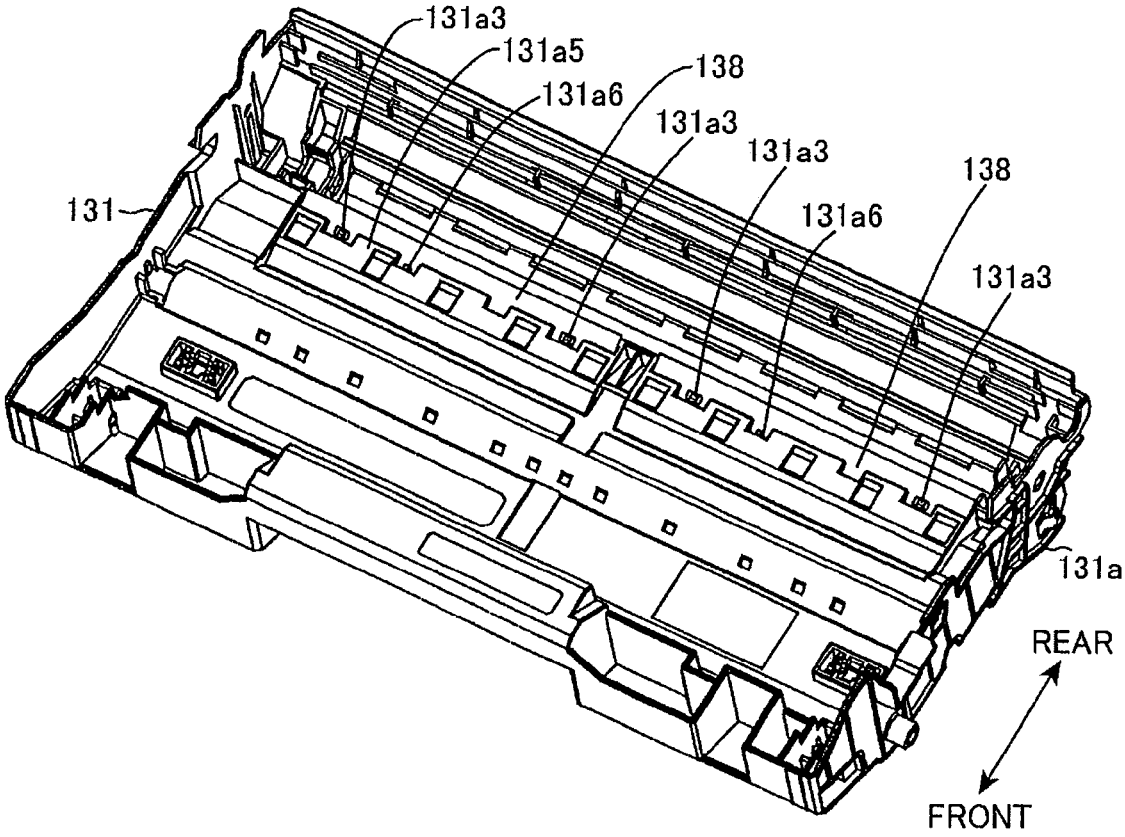
FIG. 3A is a perspective view showing the process frame shown in FIG. 2A.

FIG. 2A is enlarged cross-sectional view of the process frame 131. FIG. 2B is a further enlarged view of the part of the transfer roller cover 131*a* upstream of the transfer roller 135 in the paper conveying direction. FIG. 3A is a perspective view of the process frame 131.

As shown in FIG. 2A, the photosensitive drum 133 and the transfer roller 135 are supported by the process frame 131 so that the circumferential surface 133*a* of the photosensitive drum 133 contacts the circumferential surface 135*a* of the transfer roller 135 at a transfer position TP with a predetermined width along the paper conveying direction (a direction from right to left in FIG. 2A).

A paper inlet opening 131*b* is formed on the process frame 131 along the paper width direction in the upstream side of the transfer position TP in the paper conveying direction. The paper inlet opening 131*b* has a width slightly larger (at least a few millimeters) than a width corresponding to a largest paper size in the laser printer 1 (for example, when the largest size is A4 paper, about 210 mm). Furthermore, a paper outlet opening 131*c* is formed along the paper width direction in the downstream of the transfer position TP in the paper conveying direction. The paper outlet opening 131*c* has almost the same size as the paper inlet opening 131*b*. A lower part of the process frame 131 in the vicinity of the transfer roller 135, that is, a part between the paper inlet opening 131*b* and the paper outlet opening 131*c* constitutes the transfer roller cover 131*a*.

An introducing portion 131*a*1 as a part between the paper inlet opening 131*b* and the transfer position TP in the transfer roller cover 131*a* (that is, a part upstream of the transfer position TP in the paper conveying direction) is configured as follows so as to smoothly guide the paper inserted from the paper inlet opening 131*b* toward the transfer position TP.

As shown in FIGS. 2A and 2B, the introducing portion 131*a*1 includes a supporting portion 131*a*2. The supporting portion 131*a*2 is provided as a part close to the transfer position TP of the introducing portion 131*a*1. The supporting portion 131*a*2 has a top surface 131*a*7 that forms an upward slope in the paper conveying direction when viewed in vertical cross-section. In other words, the top surface 131*a*7 forms a downward slope toward the upstream side in the paper conveying direction. The supporting portion 131*a*2 is configured so that the top surface 131*a*7 confronts the paper path PP (refer to the two-dot chain line PP in FIG. 1). A guide film 138 is mounted on the top surface 131*a*7 of the supporting portion 131*a*2. The guide film 138 guides thin paper with low stiffness to the transfer position TP in good condition so that the toner can be satisfactorily transferred on the thin paper. The guide film 138 is disposed so that a back surface 138*r* (refer to FIG. 2B) contacts the top surface 131*a*7 of the supporting portion 131*a*2 and that a front surface 138*t* is in confrontation with the paper path PP. In other words, the guide film 138 is mounted on the top surface 131*a*7 of the supporting portion 131*a*2, thereby being supported by the supporting portion 131*a*2.

<Sectional Configuration of Guide Film>

As shown in FIG. 2A, the guide film 138 is formed of a thin plate made of a material having flexibility. The guide film 138 is fixed to the introducing portion 131*a*1 (supporting portion 131*a*2) so that a guiding portion 138*a* as rear end of the guide film 138 confronts the circumferential surface 133*a* of the photosensitive drum 133. With this configuration, a thin paper is conveyed while being bent in the upstream of the transfer position TP in the paper conveying direction, and the thin paper can be guided smoothly along the circumferential surface 133*a* of the photosensitive drum 133 from the upstream side of the transfer position TP in the paper conveying direction. Furthermore, when a thick paper with high stiffness is used, the guide film 138 is bent so as to guide the thick paper to the transfer position TP in a substantially straight state.

For example, a synthetic resin such as polyethylene naphthalate and polyimide can be suitably selected as a material for the guide film 138. The thickness of the guide film 138 can be set to approximately 0.1 to 0.2 millimeters.

As shown in FIG. 2B, the guide film 138 includes a guiding portion 138*a* at one end thereof and a base portion 138*b* at the opposite end (the upstream side in the paper conveying direction). A through-hole 138*c* for fixing the guide film 138 to the introducing portion 131*a*1 (supporting portion 131*a*2) is formed on the base portion 138*b*.

<Supporting and Fixing Configuration for Guide Film by Introducing Portion>

A protruding portion 131*a*3 is formed on the supporting portion 131*a*2. The protruding portion 131*a*3 is configured to extend through (pass through) the through-hole 138*c*. The protruding portion 131*a*3 is formed so as to obliquely extend upward toward the upstream side in the paper conveying direction (toward upper right in FIGS. 2A and 2B) and protrude from the top surface 131*a*7 of the supporting portion 131*a*2.

The protruding portion 131*a*3 has a protruding portion end face 131*a*4 as an upstream end face thereof in the paper conveying direction. The protruding portion 131*a*3 is configured to engage with an inner edge 138*c*1 of the through-hole 138*c* provided on the base portion 138*b* of the guide film 138. That is, when viewed in cross-section perpendicular to the paper width direction (cross-sectional view of FIG. 2B), the protruding portion end face 131*a*4 is formed so as to extend obliquely upward toward the upstream side in the paper conveying direction (right-upward direction in FIG. 2B). Also, when viewed in this cross-section, and the top surface 131*a*7 form an angle smaller than 90 degrees. With this configuration, when the paper conveyed in the paper conveying direction contacts the front surface 138*t* and thus a frictional force is applied to the guide film 138 in the paper conveying direction, the protruding portion end face 131*a*4 comes into contact with the inner edge 138*c*1 of the through-hole 138*c*. As a result, the guide film 138 can be prevented from separating from the supporting portion 131*a*2 and moving in the paper conveying direction. Moreover, when the thick and stiff paper is used and the guiding portion 138*a* of the guide film 138 bends downward, the protruding portion end face 131*a*4 comes into contact with the inner edge 138*c*1 of the through-hole 138, thereby preventing the base portion 138*b* from moving upward and separating from the supporting portion 131*a*2.

A confronting portion 131*a*5 is formed so as to be in confrontation with the top surface 131*a*7 of the supporting portion 131*a*2. The confronting portion 131*a*5 and the supporting portion 131*a*2 can interpose the base portion 138*b* of the guide film 138 therebetween. In other words, the confronting portion 131*a*5 holds the guide film 138 together with the supporting portion 131*a*2. As shown in FIGS. 2B and 3A, the confronting portion 131*a*5 is provided in confrontation with a part, on which the through-hole 138*c* is not formed, of the front surface 138*t* of the guide film 138 on the side of the base portion 138*b*. That is, as shown in FIG. 3A, the confronting portion 131*a*5 is provided at a part where the protruding portion 131*a*3 is not provided with respect to the paper width direction. The supporting portion 131*a*2 and the confronting portion 131*a*5 are formed so that the base portion 138*b* of the guide film 138 can be stably held by accommodating the base portion 138*b* in a slit 131*a*8 formed between the supporting portion 131*a*2 and the confronting portion 131*a*5.

<Configuration of Guide Film and Supporting Portion with Respect to Paper Width Direction>

Figure 3B:
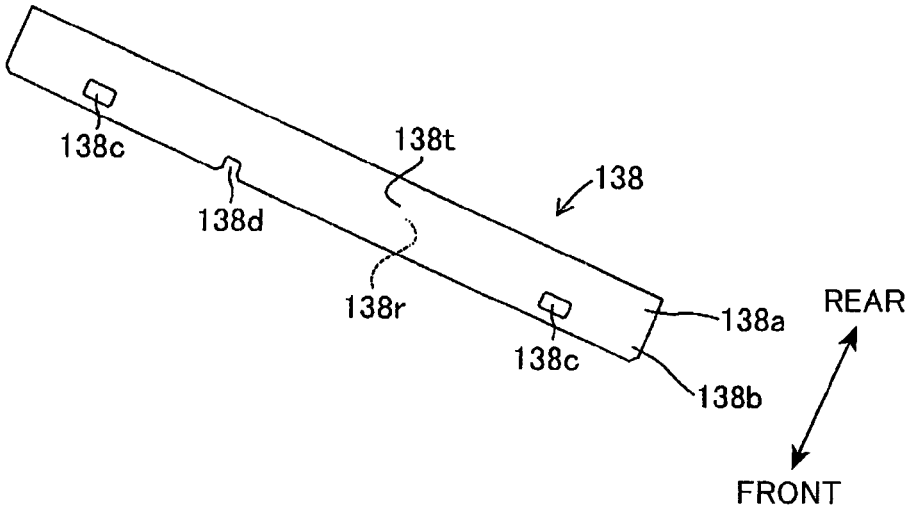
FIG. 3B is an enlarged view showing a guide film according to the illustrative aspects.

As shown in FIG. 3A, the guide film 138 is equally divided into two parts in the paper width direction The two guide films 138 are aligned in parallel to the paper width direction. FIG. 3B shows one of the guide films 138.

As shown in FIG. 3B, the through-hole 138*c* is formed at each of both ends of the guide film 138 in the paper width direction. In addition to the two through-holes 138*c*, a notched portion 138*d* for preventing a mix-up between the back surface 138*r* and the front surface 138*t* of the guide film 138 is formed on the base portion 138*b*. As shown in FIG. 3B, the notched portion 138*d* is configured to be open on a front edge of the base portion 138*b* (upstream edge in the paper conveying direction). The notched portion 138*d* is formed at a position shifted from the center of the guide film 138 in the paper width direction. In other words, the guide film 138 is asymmetrically formed with respect to the paper width direction.

As shown in FIG. 3A, identification protruding portions 131*a*6 are provided to protrude from the supporting portion 131*a*2. The transfer roller cover 131*a* (the supporting portion 131*a*2 in FIG. 2B) is configured so that the identification protruding portions 131*a*6 are accommodated in the notched portions 138*d* of the guide films 138. That is, the supporting portion 131*a*2 and the identification protruding portions 131*a*6 are configured to engage with the base portion 138*b* of the guide film 138 (see FIG. 3B). Thus, the guide film 138 has an asymmetrical shape with respect to the paper width direction, such that the shape of the guide film 138 is adapted to (matched with) the shape of the supporting portion 131*a*2.

<Configuration of Scanner Unit>

As shown in FIG. 1, the scanner unit 140 is disposed above the process frame 131. The scanner unit 140 has a scanner case 141, a polygon mirror 142 and reflecting mirrors 143, 144 and 145.

The polygon mirror 142 is supported by a rotational driving shaft of a motor (not shown) fixed to the scanner case 141 so as to be rotationally driven with a predetermined rotation speed. The polygon mirror 142 is configured to reflect a laser beam generated in a laser beam emitting part (not shown) based on image data while being rotationally driven by the motor, thereby scanning the laser beam along the paper width direction. The reflecting mirrors 143, 144 and 145 are supported in the scanner case 141 so as to irradiate the circumferential surface 133*a* of the photosensitive drum 133 with the laser beam (represented by a single-dot chain line in FIG. 1) reflected on the polygon mirror 142 through the slit 131*t* formed on the process frame 131.

<Configuration of Paper Feeding Part>

The paper feeding part 150 are comprised of a paper feeding roller 151, a paper powder removing roller 152, paper guides 153, 154 and a lower registration roller 155. The paper feeding roller 151 is rotatably supported by the main frame (not shown) of the main body 110. The paper feeding roller 151 is disposed in confrontation with the separating pad 125 so that the circumferential surface thereof contacts the separating pad 125 with a predetermined pressure.

The paper powder removing roller 152 is rotatably supported by the main frame at a position closer to the front side than the separating pad 125 is (the downstream side in the rotational direction of the paper feeding roller 151 at the time of paper feeding). The paper powder removing roller 152 is disposed so that its circumferential surface is in contact with the paper feeding roller 151. The paper guides 153 and 154 are members for guiding the paper so that the paper can be conveyed along the paper path PP. An appropriate number of the paper guides of an appropriate shape are arranged at appropriate positions. The lower registration roller 155 is a roller for adjusting orientation and conveying timing of the paper in cooperation with the upper registration roller 137. The lower registration roller 155 is disposed upstream of the position at which the photosensitive drum 133 confronts the transfer roller 135 in the paper conveying direction so as to contact the upper registration roller 137.

<Configuration of Fixing Unit>

The fixing unit 160 is disposed downstream of the position at which the photosensitive drum 133 confronts the transfer roller 135 in the paper conveying direction. The fixing unit 160 includes a fixing unit cover 161, a heat roller 162, and a pressure roller 163.

The fixing unit cover 161 is a member interposed between the process cartridge 130, and the heat roller 162 and the pressure roller 163 so that the process cartridge 130 may not be heated as far as possible. At a position at which the fixing unit cover 161 intersects the paper path PP are formed a paper inlet 161*a* and a paper outlet 161*b*. The heat roller 162 is configured by accommodating a halogen lamp in a metallic cylinder having a surface with mold release processing, and is rotatably supported in the fixing unit cover 161 so as to be rotationally driven by a motor (not shown) in a direction shown by an arrow (clockwise direction). The pressure roller 163 is a roller made of silicon rubber and is rotatably supported in the fixing unit cover 161 so as to follow the heat roller 162 to rotate in a direction shown by an arrow (counterclockwise direction) while being pressed against the hear roller 162 with a predetermined pressure.

<Configuration of Paper Discharge Unit>

The paper discharge unit 170 includes paper conveying rollers 171, paper discharge rollers 172, and a paper guide 173. The paper conveying rollers 171 are a pair of rollers rotationally driven by a motor (not shown) and are arranged in the vicinity of the paper outlet 161*b* of the fixing unit 160. The paper discharge rollers 172 are a pair of rollers rotationally driven by a motor (not shown) and are arranged in the vicinity of the paper discharge opening 111*c*. The paper guide 173 is a member for guiding the paper from the paper conveying rollers 171 to the paper discharge rollers 172 along the paper path PP.

<Operation of Laser Printer>

A summary of the operation of the laser printer 1 having the above-described configuration will be described below with reference to FIGS. 1 through 3B.

<Paper Feeding Operation>

As shown in FIG. 1, sheets of paper (not shown) stacked on the paper pressing plate 123 is urged upward toward the paper feeding roller 151 by the paper pressing plate 123. Thus, the top sheet of paper comes into contact with the circumferential surface of the paper feeding roller 151. When the paper feeding roller 151 is rotationally driven in a counterclockwise direction in FIG. 1, a leading end of the paper moves to the upper right in the figure and is held between the paper feeding roller 151 and the separating pad 125. Thus, with the rotation of the paper feeding roller 151, only the top sheet is conveyed toward the paper powder removing roller 152.

The paper is conveyed to the paper powder roller 152 by which and paper powders on the paper is removed. Then, the paper is conveyed to a contact part (registration part) between the upper registration roller 137 and the lower registration roller 155. After the leading end of the paper reaches the registration part, the lower registration roller 155 is rotationally driven at a predetermined timing, thereby correcting obliqueness of the paper and adjusting conveying timing of the paper. After that, the paper is conveyed toward the transfer position at which the photosensitive drum 133 confronts the transfer roller 135.

<Conveyance and Guide of Paper to Transfer Position>

As shown in FIG. 2A, the paper to be conveyed to the transfer position TP through the registration part enters the process frame 131 from the paper inlet opening 131*b* and passes through the top surface 131*a*7 of the supporting portion 131*a*2 which is an upstream part of the transfer roller cover 131*a* in the paper conveying direction. Subsequently, the paper comes into contact with the guiding portion 138*a* of the guide film 138, which protrudes obliquely upward at the downstream end of the introducing portion 131*a*1 in the paper conveying direction.

Here, when the paper is a thin paper with low stiffness, the paper bends to be convex upward in the upstream of the transfer position TP in the paper conveying direction and is guided to the transfer position TP along the circumferential surface 133*a* of the photosensitive drum 133 by the guiding portion 138*a* of the guide film 138. That is, the paper is conveyed along and near the circumferential surface 133*a*. Thus, the thin paper is smoothly conveyed so that the toner can be satisfactorily transferred in the vicinity of the transfer position TP.

On the contrary, when the paper is a thick paper with high stiffness, the thick paper can be guided in a substantially straight state to the transfer position TP by bending the guide film 138 downward.

<Bearing of Toner on Circumferential Surface of Photosensitive Drum>

As shown in FIG. 1, while the paper is conveyed toward the transfer position as described above, a toner image is borne on the circumferential surface 133*a* of the photosensitive drum 133 as follows.

First, the circumferential surface 133*a* of the photosensitive drum 133 is uniformly charged by the charger 134. The circumferential surface 133*a* charged by the charger 134 rotates in the direction of the arrow PD and reaches a position below the slit 131*t*. Below the slit 131*t*, the laser beam scanned along the paper width direction by the scanner unit 140 is irradiated on the circumferential surface 133*a* of the photosensitive drum 133 uniformly charged as described above. The laser beam is generated based on image data as described above. That is, the light-emitting state of the laser beam (ON/OFF pulse shape) is modulated in accordance with the image data. The laser beam thus modulated is scanned on the circumferential surface 133*a* of the photosensitive drum 133, thereby forming an electrostatic latent image on the circumferential surface 133*a*. The circumferential surface 133*a* of the photosensitive drum 133 on which the electrostatic latent image is formed rotates in the direction of the arrow PD in FIG. 1 and comes into contact with or comes close to the developing roller 132*b*. The charged toner is uniformly borne on the circumferential surface of the developing roller 132*b* in the following manner.

By rotating the feeding roller 132*c* in the direction of the arrow FD in FIG. 1, the toner adheres to the circumferential surface of the developing roller 132*b*. The circumferential surface of the developing roller 132 to which the toner is thus adhered by the feeding roller 132*c* rotates in the direction of the arrow DD in FIG. 1 and reaches the contact position with the blade 132. Then, an amount of toner adhesion and a charge amount on the circumferential surface are adjusted by the blade 132*d*. The circumferential surface, the amount of toner adhesion and the charge amount on which is thus adjusted, rotates in the direction of the arrow DD and reaches the position in confrontation with the photosensitive drum 133.

The circumferential surface 133*a* of the photosensitive drum 133 on which the electrostatic latent image is formed comes into contact with or comes close to the circumferential surface of the developing roller 132*b* on which the charged toner is borne, thereby allowing the toner to be adhered to the circumferential surface 133*a* of the photosensitive drum 133 at a pattern corresponding to the electrostatic latent image formed in the circumferential surface 133*a*. That is, the electrostatic latent image formed in the circumferential surface 133*a* of the photosensitive drum 133 is developed by the toner, and the toner image is borne on the circumferential surface 133*a*.

<Transfer of Toner Image from Circumferential Surface of Photosensitive Drum to Paper>

The toner image borne on the circumferential surface 133*a* of the photosensitive drum 133 rotates in the direction of the arrow PD, thereby being conveyed toward the transfer position. At the transfer position, the toner image is transferred from the circumferential surface 133*a* of the photosensitive drum 133 to the paper.

The circumferential surface 133*a* of the photosensitive drum 133 rotates in the direction of the arrow PD to pass through the transfer position and then reach the cleaning part 136. Then, the cleaning part 136 removes the toner remaining on the circumferential surface 133*a* and foreign matters such as dusts adhering to the circumferential surface 133*a*. The circumferential surface 133*a* thus cleaned is uniformly charged by the charger 134 to be repeatedly used for image formation.

<Fixing and Paper Discharge>

The paper onto which the toner image is transferred is conveyed to the fixing unit 160 along the paper path PP and is heated with pressure between the heat roller 162 and the pressure roller 163. Thus, the toner image is fixed on the surface of the paper. Then, the paper is sent to the paper discharge opening 111*c* via the paper discharge unit 170 and discharged on the paper discharge tray 111*b* through the paper discharge opening 111*c*.

<Effects of Configuration in the Illustrative Aspects>

Next, effects of the configuration in the above-described illustrative aspects will be described.

In the above-described illustrative aspects, as shown in FIG. 2B, the through-hole 138*c* is formed at the base portion 138*b* of the guide film 138. The sloped supporting portion 131*a*2 is provided at the introducing portion 131*a*1 of the transfer roller cover 131*a*. Furthermore, the protruding portion 131*a*3 is formed so as to protrude obliquely upward from the supporting portion 131*a*2. The protruding portion 131*a*3 extends through the through-hole 138*c* and the base portion 138*b* is placed on the supporting portion 131*a*2, allowing the base portion 138*b* to be supported by the supporting portion 131*a*2.

With such configuration, the guide film 138 can be stably fixed to the introducing portion 131*a*1 (supporting portion 131*a*2) through simple processes without using an adhesive tape, a screw, or the like. Moreover, wastes such as a releasing paper of the adhesive tape can be prevented from generating.

In the above-described illustrative aspects, the protruding portion end face 131*a*4 formed so as to extend obliquely upward toward the upstream side in the paper conveying direction (right-upward direction in FIG. 2B) and to engage with the inner edge 138*c*1 upstream of the through-hole 138*c* in the paper conveying direction.

With such configuration, when the front surface 138*t* of the guide film 138 comes into contact with the paper and a frictional force is applied to the paper in the paper conveying direction, the protruding portion end face 131*a*4 contacts the inner edge 138*c*1 of the through-hole 138*c*. As a result, it is possible to prevent the guide film 138 from separating from the supporting portion 131*a*2 and moving in the paper conveying direction. Therefore, the guide film 138 can be stably fixed to the introducing portion 131*a*1 (supporting portion 131*a*2).

With the configuration in the above-described illustrative aspects, when the thick and stiff paper is used and the guiding portion 138*a* of the guide film 138 bends downward (see FIGS. 2A and 2B), the protruding portion end face 131*a*4 contacts the inner edge 138*c*1 of the through-hole 138*c*, so that the base portion 138*b* can be prevented from moving upward and separating from the protruding portion 131*a*3.

With the configuration in the above-described illustrative aspects, the base portion 138*b* can be stably held in the slit 131*a*8 simply by inserting the base portion 138*b* of the guide film 138 into the slit 131*a*8 formed between the supporting portion 131*a*2 and the confronting portion 131*a*5.

In the above-described illustrative aspects, the through-hole 138*c* and the notched portion 138*d* are arranged so that the guide film 138 is asymmetrically shaped in the paper width direction. More specifically, the protruding portion 131*a*3 and the identification protruding portion 131*a*6 are configured to engage with the through-hole 138*c* and the notched portion 138*d*.

With such configuration, a mix-up in the attachment orientation during the attaching operation of the guide film 138 can be prevented as far as possible. That is, for example, a predetermined surface treatment (polishing, coating, etc.) may be applied to the front surface 138*t* of the guide film 138 to smoothly introduce the paper to the transfer position TP. In such case, the guide film 138 needs to be attached to the supporting portion 131*a*2 in a predetermined orientation so that the front surface 138*t* having the surface treatment can properly confront the paper path PP. With the above-described configuration, it is possible to reliably prevent the guide film 138 from being attached to the supporting portion 131*a*2 in the wrong orientation in which the front surface 138*t* and the back surface 138*r* are upside down. Furthermore, since it is possible to visually determine which of the front surface 138*t* and the back surface 138*r* faces the user, it is easy to perform an operation of attaching the guide film 138 to the supporting portion 131*a*2 of the guide film 138.

In the above-described illustrative aspects, a plurality of guide films 138 are provided by dividing the guide film 138 into a plurality of sections in the paper width direction (FIG. 3A). The through-hole 138*c* is provided on each of the base portion 138*b* of the plurality of guide films 138. The protruding portion 131*a*3 is provided at a position corresponding to each of the through-holes 138*c* of the plurality of guide films 138. By engaging the through-hole 138*c* of the guide film 138 with the protruding portion 131*a*3, each guide film 138 is fixed to the supporting portion 131*a*2, with being aligned in the paper width direction.

With such configuration, the guide film 138 can be supported uniformly in the paper width direction by the supporting portion 131*a*2. In other words, the guiding portion 138*a* is bent uniformly in the paper width direction when the paper is conveyed on the guiding portion 138*a*. Accordingly, the paper is guided to the transfer position TP uniformly in the paper width direction. Therefore, the toner can be transferred onto the paper more stably. Moreover, it becomes possible to reliably guide papers having various widths within the limit of the largest printable paper size in the laser printer 1 to the transfer position TP.

While the invention has been described in detail with reference to the above aspects thereof, it would be apparent to those skilled in the art that various changes and modifications may be made therein without departing from the spirit of the invention.

(i) An image forming apparatus according to the invention is not limited to the laser printer. Further, the transfer roller 135 and the transfer roller cover 131*a* may be supported by the main frame of the main body 110 and the developing cartridge 132 may be detachable from the main frame.

Figure 4A:
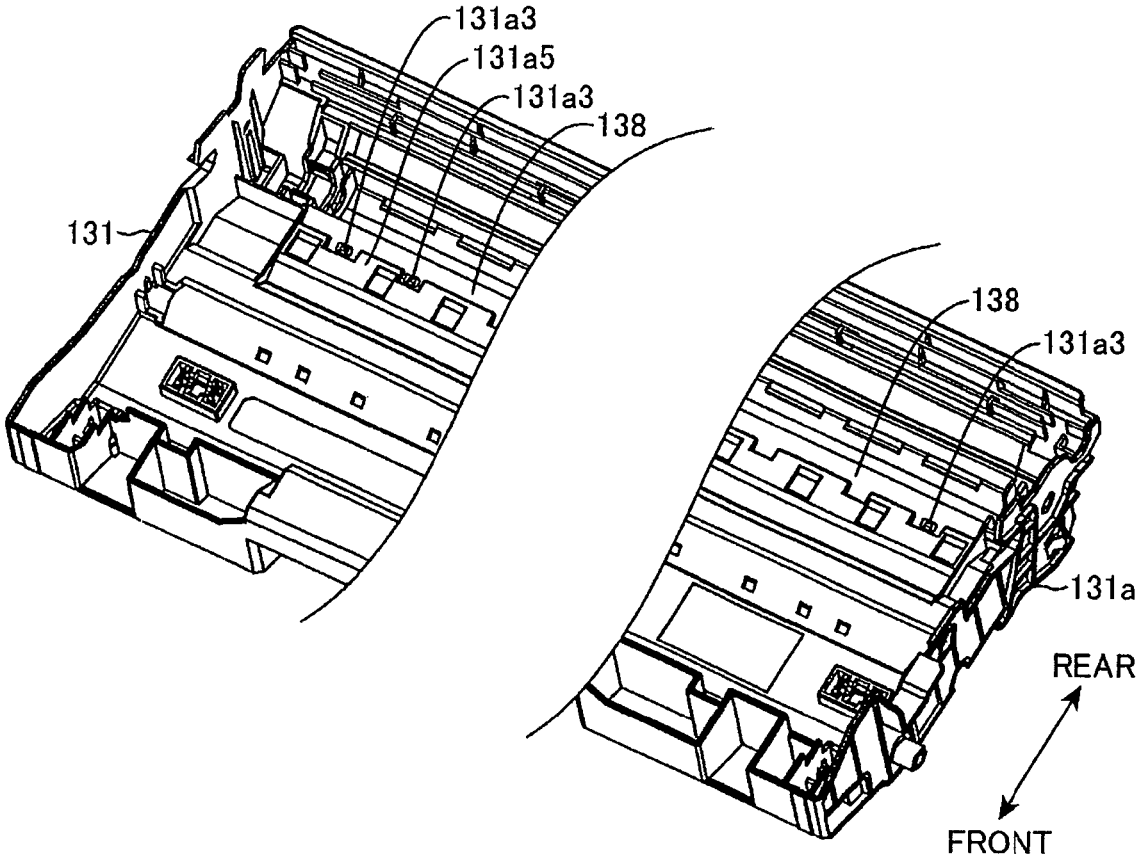
FIG. 4A is a perspective view showing a process frame according to a modification.

(ii) As shown in FIG. 4A, the guide film 138 may be configured as one piece in the paper width direction. Alternatively, the guide film may be divided into smaller pieces (i.e., three or more pieces) than in the configuration shown in FIG. 3A (two pieces) in the paper width direction.

Figure 4B:
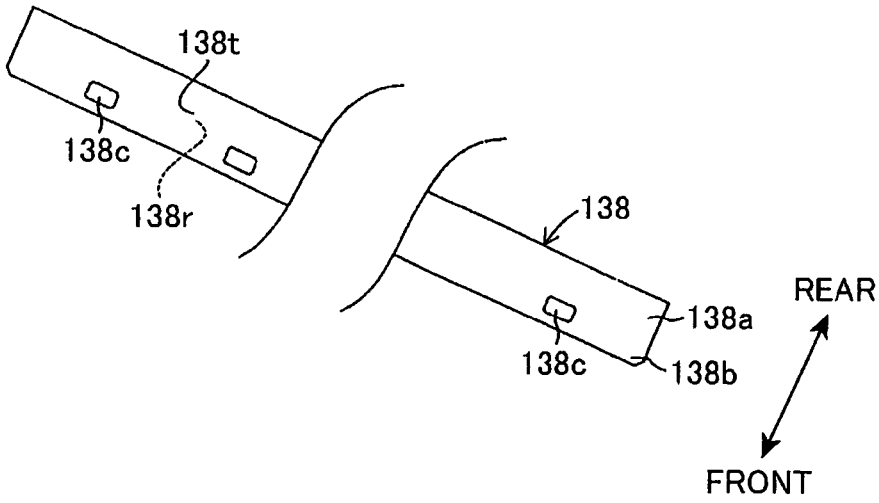
FIG. 4B is an enlarged view of a guide film according to the modification.

(iii) As shown in FIG. 4B, in order to distinguish the front surface 138*t* from the back surface 138*r*, the guide film may be provided with a plurality of through-holes 138*c* asymmetrically disposed in the paper width direction. In this case, as shown in FIG. 4A, a plurality of protruding portions 131*a*3 is also asymmetrically provided in the paper width direction, corresponding to the guide film 138 shown in FIG. 4B. Alternatively, each of the through-holes 138*c* themselves may be asymmetrically formed in the paper width direction (for example, in a shape of a horizontal arrow) and the protruding portions may be formed in the shape matching the shape of the through-holes. In summary, even when the notched portion 138*d* in the above-described illustrative aspects is omitted, the front surface 138*t* can be distinguished from the back surface 138*r* due to the shape and arrangement of the through-hole and the protruding portion engaging with the through-hole.

(iv) In the above-described illustrative aspects, the notched portion 138*d* serving as an accommodating portion is configured to open toward the front at the base portion 138*b* (FIG. 3B). However, the accommodating portion is not limited to the above-described configuration. For example, the accommodating portion may be configured as a through-hole formed on the base portion 138*b*, or may be configured as a recessed part that accommodates the identification protruding portion 131*a*6 therein so as to cover the same.

(v) The confronting portion 131*a*5 may be omitted.

(vi) The protruding portion 131*a*3 and/or the identification protruding portion 131*a*6 may protrude obliquely downward from the side of the confronting portion 131*a*5 so as to confront the supporting portion 131*a*2.

(vii) Elements described in terms of effects and functions among elements that constitute means for solving the problem of the invention may have any configuration capable of realizing the effects and functions in addition to the specific configurations disclosed in the above-described illustrative aspects and modifications,

What is claimed is:

1. A transfer device comprising:

a frame;

a transfer roller rotatably supported by the frame; and a guiding member disposed at the frame upstream of the transfer roller in a conveying direction of a recording medium, thereby guiding the recording medium to a transfer position, the guiding member having a front surface configured to confront the recording medium and a back surface opposite the front surface, the guiding member comprising:

a guiding portion configured to contact the recording medium for guiding the recording medium to the transfer position; and a base portion positioned upstream of the guiding portion in the conveying direction, the base portion being formed with at least one through-hole, each through-hole having an inner edge, wherein the frame comprises:

a supporting portion configured to contact the back surface of the guiding member, thereby supporting the guiding member; and a protruding portion that protrudes through the at least one through-hole and that engages with the inner edge, thereby fixing the base portion of the guiding member to the frame.

2. The transfer device according to claim 1, wherein the guiding member extends toward a peripheral surface of an image bearing member, allowing an end of the guiding portion to be positioned adjacent to the peripheral surface.

3. The transfer device according to claim 1, wherein the protruding portion protrudes upward from the supporting portion, when the transfer device is disposed in an orientation in which the transfer device is intended to be used.

4. The transfer device according to claim 1, wherein the frame further comprising a confronting portion provided in confrontation with the base portion of the guiding member and holding the guiding member together with the supporting portion.

5. The transfer device according to claim 1, wherein the guiding member has an asymmetrical shape with respect to a width direction of the recording medium, the width direction being a direction perpendicular to the conveying direction of the recording medium; and wherein the frame has an asymmetrical configuration for matching the asymmetrical shape of the guiding member, thereby engaging with the guiding member.

6. The transfer device according to claim 5, further comprising an identification portion that protrudes from the frame, wherein the base portion of the guiding member is formed with an accommodating portion that accommodates the identification portion, the accommodating portion being formed in an asymmetrical arrangement with respect to the width direction.

7. The transfer device according to claim 1, wherein the guiding member comprises a plurality of guiding members aligned in a width direction of the recording medium, the width direction being a direction perpendicular to the conveying direction of the recording medium.

8. The transfer device according to claim 1, wherein the protruding portion has a protruding portion end face that is an upstream end face of the protruding portion in the conveying direction;

wherein the protruding portion end face extends obliquely upward toward an upstream side in the conveying direction, when viewed in cross-section perpendicular to a width direction of the recording medium; and wherein the protruding portion end face is contactable with the inner edge of the at least one through-hole, thereby preventing the guiding member from separating from the protruding portion and moving in the conveying direction.

9. The transfer device according to claim 8, wherein the supporting portion has a top surface that confronts a conveying path of the recording medium; and wherein the protruding portion end face and the top surface form an angle smaller than 90 degrees, when viewed in the cross-section perpendicular to the width direction of the recording medium.

10. An image forming apparatus comprising:

a frame;

an image bearing member having a peripheral surface and configured to bear a developer image thereon;

a transfer roller rotatably supported by the frame and disposed in confrontation with the image bearing member, the image bearing member and the transfer roller confronting each other at a transfer position, the transfer roller transferring the developer image borne on the peripheral surface of the image bearing member to a recording medium; and a guiding member disposed at the frame upstream of the transfer roller in a conveying direction of the recording medium, thereby guiding the recording medium to the transfer position, the guiding member having a front surface configured to confront the recording medium and a back surface opposite the front surface, the guiding member comprising:

a guiding portion configured to contact the recording medium for guiding the recording medium to the transfer position; and a base portion positioned upstream of the guiding portion in the conveying direction, the base portion being formed with at least one through-hole, each through-hole having an inner edge, wherein the frame comprises:

a supporting portion configured to contact the back surface of the guiding member, thereby supporting the guiding member; and a protruding portion that protrudes through the at least one through-hole and that engages with the inner edge, thereby fixing the base portion of the guiding member to the frame.

11. A process cartridge configured to be attachable to and detachable from an image forming apparatus, comprising:

a cartridge frame;

an image bearing member having a peripheral surface and configured to bear a developer image thereon;

a transfer roller rotatably supported by the cartridge frame and disposed in confrontation with the image bearing member, the image bearing member and the transfer roller confronting each other at a transfer position, the transfer roller transferring the developer image borne on the peripheral surface of the image bearing member to a recording medium; and a guiding member disposed at the cartridge frame upstream of the transfer roller in a conveying direction of the recording medium, thereby guiding the recording medium to the transfer position, the guiding member having a front surface configured to confront the recording medium and a back surface opposite the front surface, the guiding member comprising:

a guiding portion configured to contact the recording medium for guiding the recording medium to the transfer position; and a base portion positioned upstream of the guiding portion in the conveying direction, the base portion being formed with at least one through-hole, each through-hole having an inner edge, wherein the cartridge frame comprises:

a supporting portion configured to contact the back surface of the guiding member, thereby supporting the guiding member; and a protruding portion that protrudes through the at least one through-hole and that engages with the inner edge, thereby fixing the base portion of the guiding member to the cartridge frame.

12. The process cartridge according to claim 11, wherein the guiding member extends toward the peripheral surface of the image bearing member, allowing an end of the guiding portion to be positioned adjacent to the peripheral surface.

13. The process cartridge according to claim 11, wherein the protruding portion protrudes upward from the supporting portion, when the process cartridge is disposed in an orientation in which the process cartridge is intended to be used.

14. The process cartridge according to claim 11, wherein the cartridge frame further comprising a confronting portion provided in confrontation with the base portion of the guiding member and holding the guiding member together with the supporting portion.

15. The process cartridge according to claim 11, wherein the guiding member has an asymmetrical shape with respect to a width direction of the recording medium, the width direction being a direction perpendicular to the conveying direction of the recording medium; and wherein the cartridge frame has an asymmetrical configuration for matching the asymmetrical shape of the guiding member, thereby engaging with the guiding member.

16. The process cartridge according to claim 15, further comprising an identification portion that protrudes from the cartridge frame, wherein the base portion of the guiding member is formed with an accommodating portion that accommodates the identification portion, the accommodating portion being formed in an asymmetrical arrangement with respect to the width direction.

17. The process cartridge according to claim 11, wherein the guiding member comprises a plurality of guiding members aligned in a width direction of the recording medium, the width direction being a direction perpendicular to the conveying direction of the recording medium.

18. The process cartridge according to claim 11, wherein the protruding portion has a protruding portion end face that is an upstream end face of the protruding portion in the conveying direction;

wherein the protruding portion end face extends obliquely upward toward an upstream side in the conveying direction, when viewed in cross-section perpendicular to a width direction of the recording medium; and wherein the protruding portion end face is contactable with the inner edge of the at least one through-hole, thereby preventing the guiding member from separating from the protruding portion and moving in the conveying direction.

19. The process cartridge according to claim 18, wherein the supporting portion has a top surface that confronts a conveying path of the recording medium; and wherein the protruding portion end face and the top surface form an angle smaller than 90 degrees, when viewed in the cross-section perpendicular to the width direction of the recording medium.

* * * * *

UNITED STATES PATENT AND TRADEMARK OFFICE

CERTIFICATE OF CORRECTION

PATENT NO. : 7,346,304 B2
APPLICATION NO. : 11/410220
DATED : March 18, 2008
INVENTOR(S) : Takeyuki Takagi It is certified that error appears in the above-identified patent and that said Letters Patent is hereby corrected as shown below:

On the Title Page, Item (56) References Cited
Please delete "2001/0010469" insert --2001/0010769--.

Signed and Sealed this

Sixth Day of January, 2009

JON W. DUDAS
*Director of the United States Patent and Trademark Office*